US006752661B2

(12) United States Patent
Gu et al.

(10) Patent No.: US 6,752,661 B2
(45) Date of Patent: Jun. 22, 2004

(54) METAL SHIELD HAVING BENT EDGES AND METHOD OF MANUFACTURING

(75) Inventors: Hao Gu, Kunsan (CH); Guang-qian Chen, Kunsan (CH)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 317 days.

(21) Appl. No.: 09/905,013

(22) Filed: Jul. 12, 2001

(65) Prior Publication Data

US 2002/0168897 A1 Nov. 14, 2002

(30) Foreign Application Priority Data

May 8, 2001 (TW) ..... 90207488

(51) Int. Cl.[7] ..... H01R 13/648
(52) U.S. Cl. ..... 439/607; 72/334

(58) Field of Search ..... 439/607–610; 29/592.1, 882; 72/329, 334, 337, 347

(56) References Cited

U.S. PATENT DOCUMENTS 5,358,428 A * 10/1994 Bixler et al. ..... 439/607

* cited by examiner

*Primary Examiner*—Son V. Nguyen
(74) *Attorney, Agent, or Firm*—Wei Te Chung

(57) ABSTRACT

A method of manufacturing a metal shield of an electrical connector comprises following steps: (a) stamping step to stamp a metal carrier continuously to form a framework having an underside and sidewall; (b) cutting step to cut the underside of the framework out and form a thin edge at the bottom of the sidewall; (c) trimming step to prune the thin edge of sidewall; (d) shaping step to stamp the framework continuously with a punch having chamfers.

7 Claims, 8 Drawing Sheets

METAL SHIELD HAVING BENT EDGES AND METHOD OF MANUFACTURING

BACKGROUND OF THE INVENTION

1. Field of the Invention

The present invention is generally related to a metal shield of an electrical connector and method of manufacturing, and more particular to a metal shield having continuous bent edge of an electrical connector and method of manufacturing.

2. Description of the Related Art

Port connector is a sort of necessary apparatus in transmitting signals between a computer and a peripheral apparatus. Familiar port connectors include D-shaped connectors between mainframe and a monitor of a computer, USB (Universal Serial Bus) connectors between the mainframe and a keyboard or a mouse of a computer, and IEEE 1394 (a standard established by Institute of Electrical & Electronic Engineers) connectors. In order to receive a mating plug in and provide shielding and grounding effect to ensure transmission of signals therebetween, the foregoing port connector generally has a metal exterior shield as a common characteristic. There are two known methods of manufacturing the metal shield of the electrical connector. First method is to stamping a flat rectangular piece continuously and join two edges together to produce a metal framework having a sidewall, wherein bottom edge of the framework is bent outwardly at a given angle to guide a mating plug. Most shields of conventional USB connectors made by the foregoing method are typically shown in FIG. 7. However, when the two bottoms are transfigured or shifted appreciably, rectangular shape of the shield will be damaged. In addition, bent edges 42 of metal shield 4 as shown in FIG. 7 have to be formed at bottom edges 41 but not at the corners 43 because of limitation of existing technique. The only way to revolve this is to cut the edge at the corners instead of forming bent edges, but it will affect appearance of the whole electrical connector.

Second method of manufacturing a shield is to stamping plat piece to form a rectangular framework having continuous edges from a flat carrier as shown in FIG. 8. Many connectors such as D-shaped connector, micro IEEE 1394 connector are commonly made by this approach. Referring to FIG. 8, an electrical connector having a metal shield 5 manufactured by this method is shown. It is inevitable that corners 51 of continuous edge of the shield 5 will split as shown in FIG. 8 while being bent outwardly. In addition, users are likely to be hurt by burred edges of the corners, and it will affect appearance of the electrical connector too.

Hence, an improved metal shield of electrical connector is required to overcome the disadvantages of the prior art.

BRIEF SUMMARY OF THE INVENTION

Therefore, an objective of the present invention is to provide an improved metal shield of an electrical connector which has a continuous and smooth bent edge.

Another objective of the present invention is to provide a method of manufacturing a metal shield of an electrical connector to obtain a continuous and smooth bent edge to guide a mating electrical connector.

To achieve the above-mentioned objectives, in the method of the present invention, a metal shield having a continuous and smooth bent edge is produced by the following steps:

(a) stamping step: stamping a metal carrier continuously to form a framework having an underside, a continuous sidewall and a vaulted portion therebetween, the vaulted portion has a radius equal to the thickness of the carrier formed at a bottom of the sidewall, the thin edge is thinner than the sidewall;

(b) cutting step: cut the underside of the framework off that produced during the stamping step and form a thin edge at a bottom of the sidewall;

(c) trimming step: trim the thin edge of sidewall by a length equal to the radius of the vaulted portion and burrs generated while trimming the thin edge away, thereby the sidewall has equal thickness and a smooth section; and (d) shaping step: bending the bottom of the sidewall to from at an angle of 120~170 degrees with respect to the sidewall.

According to another embodiment of the present invention, the foregoing stamping step further includes a first step to provide a suitable carrier to form the framework and a second step to stamping the carrier obtained via the first step with gradual changed punches to form a framework which has an underside and a continuous sidewall.

Metal shield manufactured by above-mentioned steps includes a continuous sidewall and a bugle-like portion, wherein the sidewall covers an insulative housing of the electrical connector and the bugle-shaped edge is to guide a mating electrical connector.

Other objects, advantages and novel features of the invention will become more apparent from the following detailed description of the present embodiment when taken in conjunction with the accompanying drawings.

BRIEF DESCRIPTION OF THE DRAWINGS

The present invention is further described with reference to the accompanying drawings in which.

DETAILED DESCRIPTION OF THE INVENTION

Figure 1:
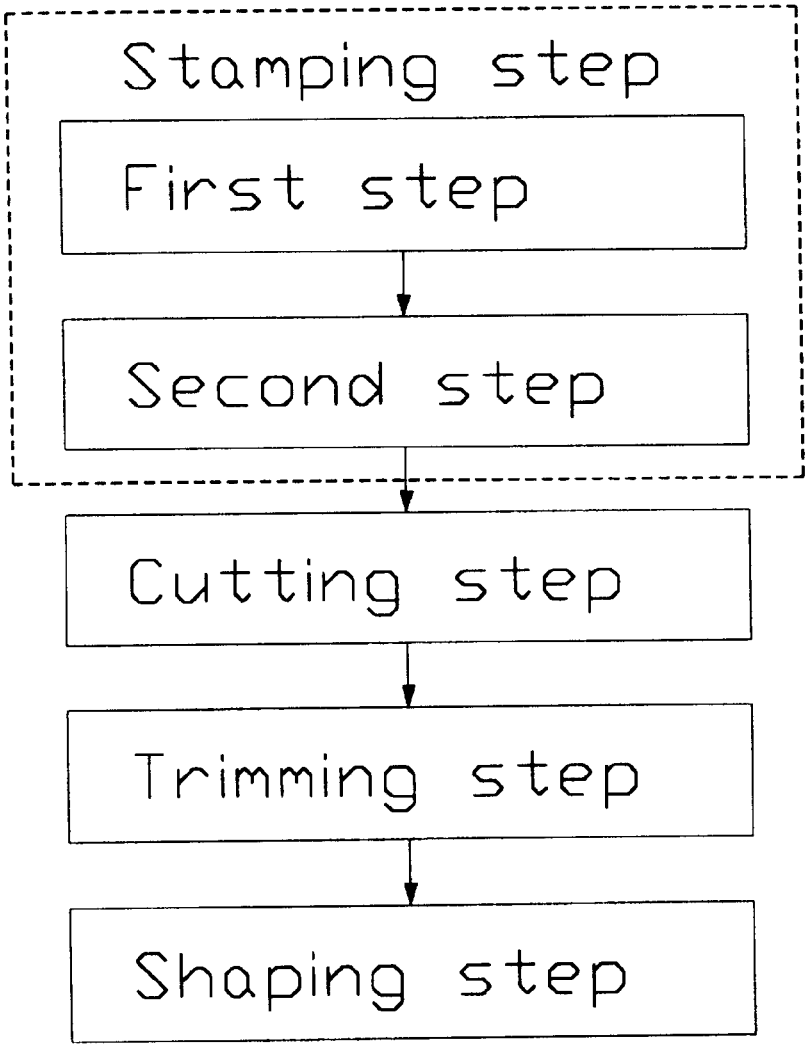
FIG. 1 is a flow chart of manufacturing process in accordance with the present invention to manufacture a shield of an electrical connector.

Referring to FIG. 1, a method of manufacturing a metal shield of an electrical connector includes a stamping step, a cutting step, a trimming step, and a shaping step.

Figure 6:
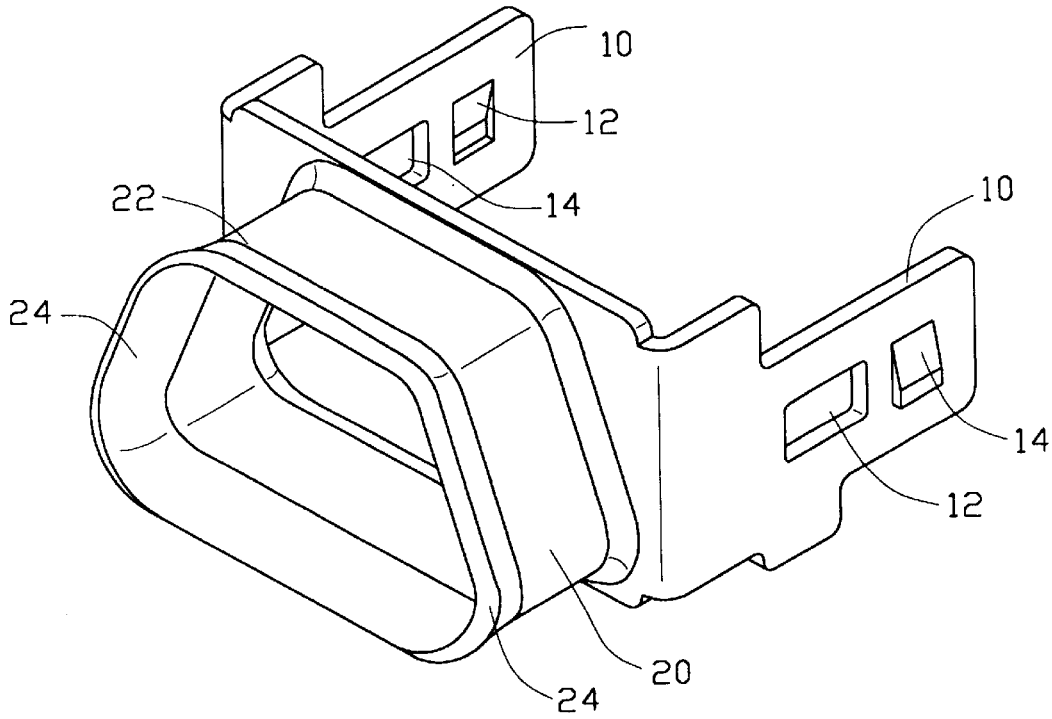
FIG. 6 is a perspective view of an electrical connector manufactured by the method in accordance with the present invention.
Figure 7:
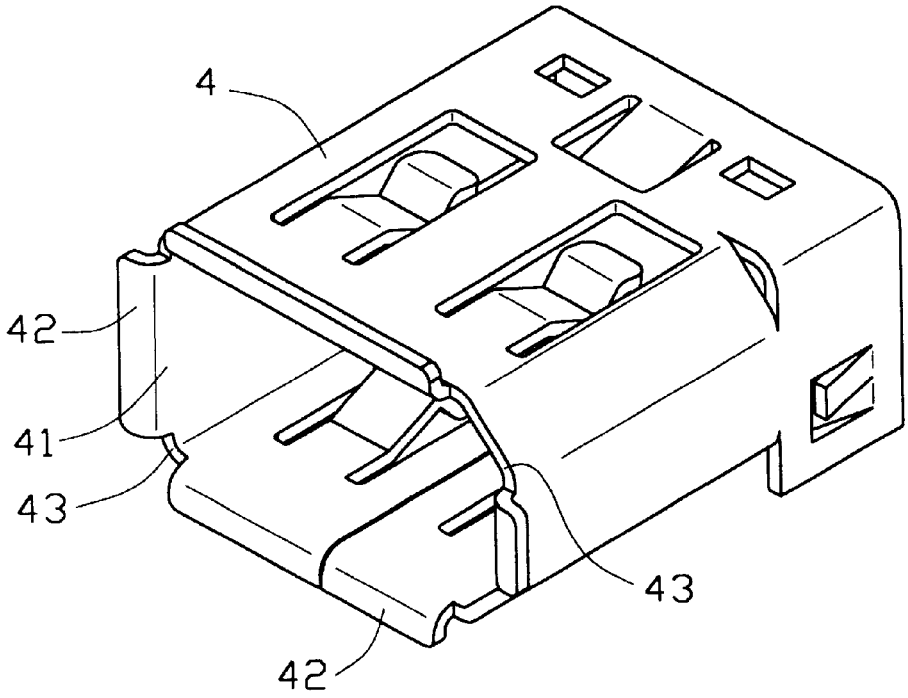
FIG. 7 (PRIOR ART)
FIG. 7 is a perspective view of a shield of an USB connector manufactured by one conventional method.

The stamping step further includes a first step and a second step. The first step is to cut down a suitable piece from a metal carrier to form a framework of the metal shield. In this embodiment, taking the metal shield of a micro IEEE 1394 connector (referring to FIG. 6) as an example, dimensions of a suitable piece obtained from the carrier are 24*12 mm. While profile of a framework of the shield is about an isosceles trapezoid and the piece will have a distortion due to being stamped, the suitable piece should be large enough to fulfill extending of the carrier. The suitable piece has four connecting arms at corners thereof to connect with the carrier.

Figure 2:
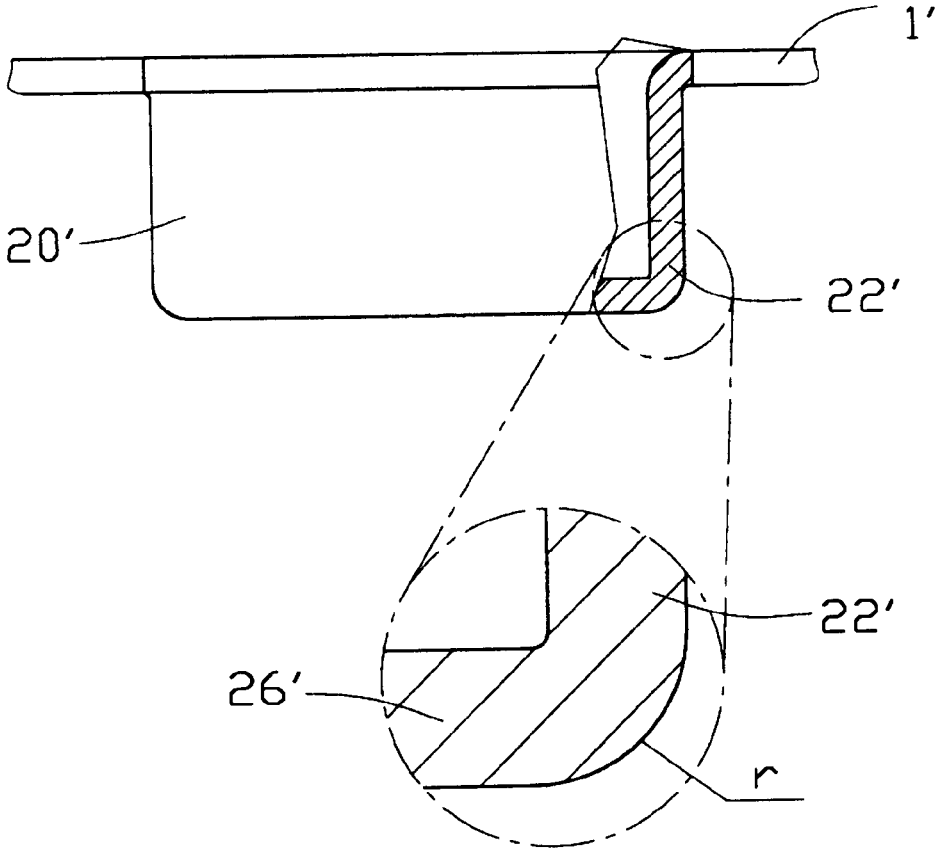
FIG. 2 is a partial cross sectional view of the shield after stamping step.

The second step is stamping the carrier 1' continuously with a series of punches till a framework 20' of the metal shield is formed. Referring to FIG. 2, the framework 20' has an underside 26', a continuous sidewall 22' and a vaulted portion of a radius r therebetween.

Figure 3:
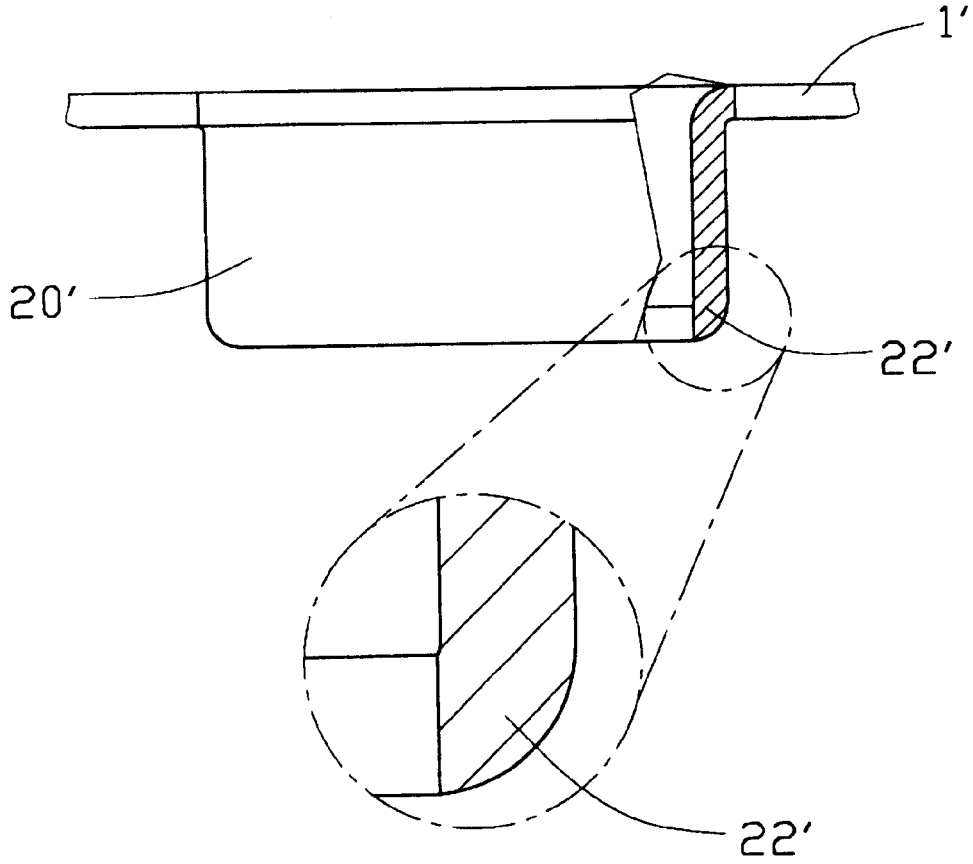
FIG. 3 is a partial cross sectional view of the shield after cutting step.

The underside 26' is then cut off from the framework 20' by a punch having a knife-edge to obtain a hollow metal shield as shown in FIG. 3. According to teaching of general knowledge of mechanics, the vaulted portion must have the biggest strain in the carrier 20'. By the way, a thin edge is formed at a bottom of the sidewall 22' much thinner than the sidewall 22'. After the underside 26' being cut as shown in amplificatory view in FIG. 3, it is inevitable that corners of the framework 20' will split if edges of the sidewall 22' is bent directly. Therefore, a trimming step is necessary to be put up before the shaping step.

Figure 4:
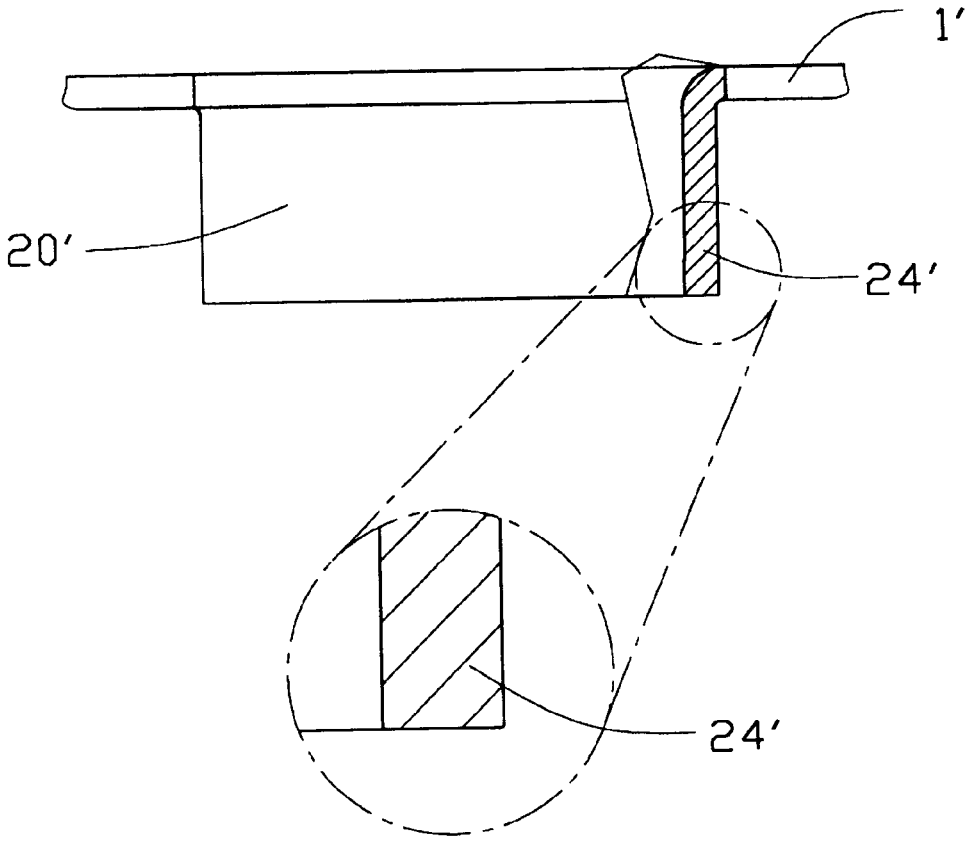
FIG. 4 is a partial cross sectional view of the shield after trimming step.

Trimming step is to trim the thin edge adjacent to the sidewall 22' of the above-mentioned framework 20' and wipe off burrs generated during the cutting step, thereby the sidewall 22 has equal thickness and smooth section. In the trimming step, the thin edge is ground firstly, however it can be embodied with other means, e.g. cutting. Length of the edge portion cut from the sidewall must be larger than thickness of the carrier 20'. In theory, perfect length of the thin edge cut off from the sidewall is equal to the thickness of the carrier 20', but in actual operation, there will be a distortion which makes the thin edge longer than r. Referring to FIG. 4, the framework 20' obtained by above-mentioned steps has uniform thickness. Also, cross-section of the framework is smooth which facilitates the shaping step.

Figure 5:
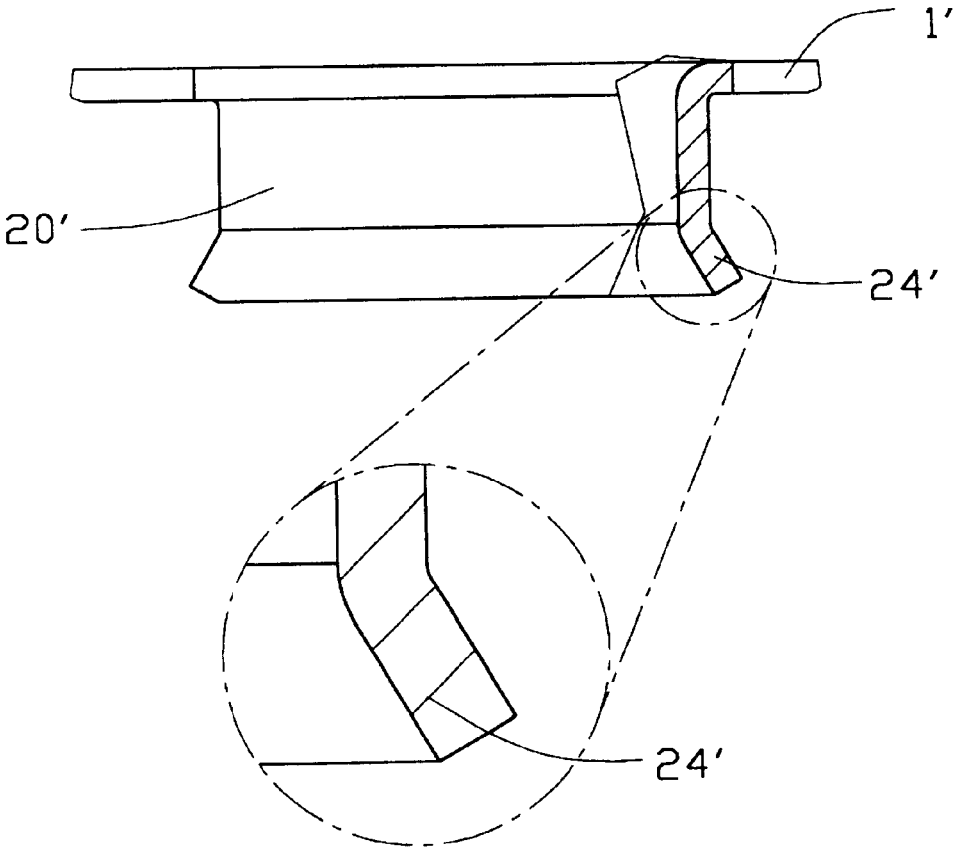
FIG. 5 is a partial cross sectional view of the shield after shaping step.

A shaping step stamps the framework 20' obtained by above steps continuously with a series of punches having campers (not shown) till bottom of the sidewall 22' forms a bugle shape. In the present embodiment, a module (not shown) is received in the framework 20' and a metal ringer (not shown) is placed at the outer surface. By this arrangement, portions of the framework 20' except for the edge will be prevented from being deformed and improper distortion will be corrected. In the shaping step, the edge will be bent 120~175 degrees against the sidewall 22'. In the present embodiment, 150~160 degrees is preferred (FIG. 5). It is to be noticed that elongation rate δ must be taken account of to ascertain length of the edge to be bend and angle between the edge and the sidewall 22'. Assume the perimeter of the framework 20' is L1 before the shaping step and is L2 after the shaping step, then, $$\delta=(L2-L1)/L1$$

The elongation rate δ less than 50% is preferred in practice. Of course, the δ may be amplified if the metal carrier 2' to manufacture the framework 20' has an apt elongation rate.

Figure 8:
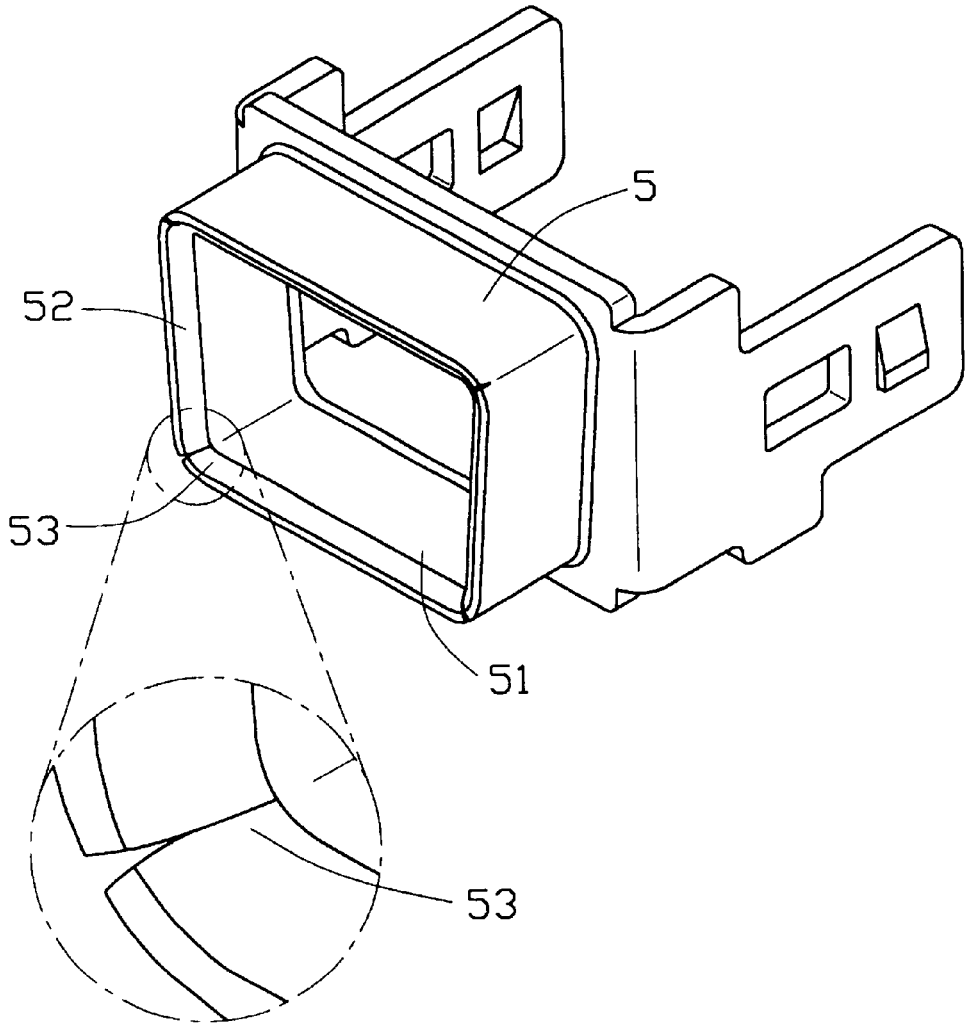
FIG. 8 (PRIOR ART)
FIG. 8 is a perspective view of a shield of an electrical connector manufactured by another conventional method.

In the present embodiment, suitable steps are employed to stamp a shield portion of a pair of wings 10 as shown in FIG. 8 and to punch a hole 12 and a barb 14 on each of the wings 10 to assemble with an insulative housing of the electrical connector (not shown). Thus, a usable metal shield is completed.

Referring to FIG. 8, a metal shield obtained by above mentioned manufacturing steps includes a pair of wings 10 and a framework 20 integrally formed with the wings 10, wherein the wings 10 are assembled with an insulative housing to shield the housing and the framework 20 surrounds terminals of the electrical connector to provide a space to receive a mating connector (not shown). The framework 20 has a continuous bent edge 24 to form a bugle shape. A hole 12 and a barb 14 are defined on each wing 10 to assemble with the insulative housing firmly. Because the framework 20 has continuous bent edge 24 and smooth section, the electrical connector has an improved shielding effect and attribute and a better appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of manufacturing a metal shield of an electrical connector, comprising the steps of:

stamping a metal carrier continuously to form a framework having an underside, a continuous sidewall and a vaulted portion between the underside and the sidewall;

cutting the underside of the framework off to form a thin edge at a bottom of the sidewall, the thin edge being thinner than the sidewall;

trimming the thin edge;

shaping a front portion of the sidewall to obtain a bugle-shaped edge; and machining a pair of wings of the metal shield formed at a rear thereof to obtain a completed metal shield after the shaping step; wherein the vaulted portion formed during the stamping step has a radius equal to the thickness of the metal carrier, and wherein the trimming step comprises trimming the thin edge by a length equal to the radius of the vaulted portion.

2. The method of claim 1, further comprising a step of trimming a plurality of burrs generated during the cutting step.

3. The method of claim 1, wherein the thin edge is trimmed off with a length larger than a thickness of the metal carrier.

4. The method of claim 1, wherein the shaping step comprises stamping the framework from both inner face and outer face of the framework simultaneously.

5. The method of claim 4, wherein the shaping step comprises bending the bottom of the sidewall to form at an angle of 120~170 degrees with respect to the sidewall.

6. The method of claim 5, wherein the shaping step comprises stamping said framework with a series of punches having champers at four corners thereof.

7. The method of claim 1, wherein said stamping step includes a first step of providing a suitable carrier and a second step of stamping the carrier with a series of punches to form the framework.

* * * * *